US005080037A

United States Patent [19]

Nakagawa et al.

[11] Patent Number: 5,080,037

[45] Date of Patent: Jan. 14, 1992

[54] DEVELOPING DEVICE

[75] Inventors: Shuichi Nakagawa, Swita; Yuji Enoguchi, Aigashiosaka, both of Japan

[73] Assignee: Minolta Camera Kabushiki Kaisha, Osaka, Japan

[21] Appl. No.: 601,428

[22] Filed: Oct. 23, 1990

[30] Foreign Application Priority Data

Oct. 26, 1989 [JP] Japan ..... 1-279286
Oct. 27, 1989 [JP] Japan ..... 1-280361

[51] Int. Cl.[5] ..... G03G 15/08

[52] U.S. Cl. ..... 118/653; 118/661; 355/245

[58] Field of Search ..... 355/245, 246, 260, 259, 355/210, 251, 253; 118/653, 651, 661, 656, 657

[56] References Cited

U.S. PATENT DOCUMENTS 4,100,884 7/1978 Mochizuki et al. ..... 118/653
4,760,422 7/1988 Seimiya et al. ..... 355/253
4,791,882 12/1988 Enoguchi et al. ..... 118/653
4,883,017 11/1989 Yuji et al. ..... 118/653
4,987,454 1/1991 Natsuhara et al. ..... 355/259

*Primary Examiner*—A. T. Grimley
*Assistant Examiner*—Sandra L. Brasé
*Attorney, Agent, or Firm*—Burns, Doane, Swecker & Mathis

[57] ABSTRACT

The present invention discloses a mono-component developing device comprising a rotatable drive roller which confronts a rotatable photoreceptor, a flexible member arranged on the exterior surface of the drive roller and having a peripheral length greater than a peripheral length of the drive roller, an elastic pad provided on the side opposed to the side confronting the photoreceptor of the drive roller, and an elastic plate arranged at both ends of the flexible member in an axial length thereof. In the developing device having the above construction the flexible member onto which a toner is supplied is pressed toward the photoreceptor by the elastic pad while being pressed by the elastic plate in the axial direction of the flexible member, so that the flexible member contacts with the surface of the photoreceptor on the side confronting the photoreceptor of the drive roller to supply the toner to an electrostatic latent image formed on the photoreceptor surface.

16 Claims, 9 Drawing Sheets

DEVELOPING DEVICE

BACKGROUND OF THE INVENTION

1. Field of the Invention

The present invention relates to a developing device for use in electrophotographic machines and the like, and more specifically relates to a monocomponent type developing device using only a toner as the developing material.

2. Description of the Related Arts

Conventional monocomponent type developing devices using only a toner as the developing material typically supply a nonmagnetic toner to the surface of an elastic roller for transporting said toner, and charge the aforesaid toner supplied to the surface of the elastic roller through pressure applied by a blade or similar type of toner regulating member which also regulates the thickness of the toner layer on the surface of the elastic roller.

The surface of the elastic roller, upon which is formed a toner layer of a specified thickness as previously described, makes touching contact with the surface of an image bearing member such as a photoconductive drum or the like, so as to transfer the toner from the aforesaid elastic roller to the specified location of an electrostatic latent image formed on the surface of the aforesaid image bearing member.

In the aforesaid type of developing device, the surface hardness of the elastic roller must be relatively high because the toner supplied to the surface of the elastic roller is electrically charged through pressure contact with a blade or similar toner regulating member.

Further, in the process wherein the surface of the elastic roller makes contact with the surface of the image bearing member to supply toner to the location of the electrostatic latent image formed on the surface of said image bearing member, the entire surface of said elastic roller along the axial direction must lightly come into contact with the surface of the image bearing member because the surface of said image bearing member may be damaged and the image formed on the image bearing member may be disturbed through contact with the elastic roller.

However, it is extremely difficult to accomplish the previously described light contact between the entire surface along the axial direction of the elastic roller having a relatively high hardness and the surface of the image bearing member. Therefore, one or the other of the aforesaid requirements must be sacrificed in the previously mentioned types of conventional developing devices, causing certain disadvantages which lead to inadequate image quality.

A developing device having the construction shown in FIG. 1 has been proposed to eliminate the disadvantages of previously described monocomponent type developing device. As shown in FIG. 1, a pliable sleeve-like toner transporting member 2 having a diameter greater than drive roller 1 is disposed around the exterior circumference of said drive roller 1, and a guide member 3, which is formed in a semicircular shape with an interior diameter that is the same as the exterior diameter of drive roller 1, is provided in the axial direction on both sides of said toner transporting member 2, such that toner transporting member 2 makes pressure contact with drive roller 1 by means of said guide member 3 excluding the developing region wherein member 2 confronts the surface of photoconductive member 4.

At the same time, member 2 forms a slack portion "D" that protrudes from drive roller 1 in the developing region wherein member 2 confronts photoconductive member 4, such that said slack portion "D" makes light contact with the surface of photoconductive member 4.

In the case of the aforesaid developing device, drive roller 1 is rotated in the arrow "a" direction by a driving device such as a motor or the like (not shown in the drawing), and toner transporting member 2 which is pressed against drive roller 1 by means of guide member 3 is driven by means of the frictional force produced between said toner transporting member 2 and drive roller 1.

While toner 5 is in transit being transported to the photoconductive member 4 side by toner transporting member 2 driven in the previously described manner, the quantity of toner supplied onto the toner transporting member 2 is regulated by regulating blade 8, and after toner 5 is sufficiently triboelectrically charged between regulating blade 8 and toner transporting member 2 the slack portion "D" of toner transporting member 2 makes light contact with the surface of photoconductive member 4 in the developing region as previously described so as to transfer the triboelectrically charged toner 5 supplied from toner transporting member 2 to the surface of photoconductive member 4.

When the previously described developing device is used, toner 5 can be adequately charged, and toner 5 can be supplied to the location of the electrostatic latent image formed on the surface of photoconductive member 4 without damaging the surface of said photoconductive member 4.

In the aforesaid developing device, toner transporting member 2 is pressed against drive roller 1 by guide member 3, and toner transporting member 2 is driven in conjunction with the rotation of drive roller 1 by means of the frictional force produced between drive roller 1 and toner transporting member 2 by the force of the aforesaid pressure contact therebetween. Accordingly, toner transporting member 2 must be uniformly pressed agaist drive roller 1 with a constant pressure by guide member 3 to achieve suitable stable driving rotation of said toner transporting member 2.

When the aforesaid guide member 3 is formed of a polyacetal, phenol, nylon or like resin, a high degree of precision is required when setting the guide member to the device and manufacturing of guide member 3 in order to achieve suitable stable driving rotation of toner transporting member 2 in conjunction with the rotation of drive roller 1, thereby causing an extremely difficult problem in the manufacture of said guide member 3.

Further, when disturbances occur during the formation of guide member 3 with the resin and the internal diameter of guide member 3 becomes larger, toner transporting member 2 cannot be smoothly and uniformly pressed against drive roller 1 by guide member 3, causing toner transporting member 2 to slip. This slip causes toner 5 to be unstably transported by toner transporting member 2 and produces irregularities in the density of the image. On the other hand, when the internal diameter of guide member 3 becomes smaller, a large torque is required to drive the rotation of drive roller 1, thereby causing damage to toner transporting member 2.

The aforesaid guide member 3 may also be formed of pliable expanded material such as molto pren (Trademark) and the like. However, when toner transporting member 2 is pressed against drive roller 1 by a guide member 3 made of the aforesaid expanded material, it is difficult to press toner transporting member 2 against drive roller 1 with stable pressure, such that the state of contact of toner transporting member 2 with the surface of photoconductive member 4 is nonuniform, thereby producing the problem of irregular image density. After long-term use, the expanded material becomes fatigued, thereby reducing the pressure contact force applied by guide member 3 and causing the toner transporting member to slip.

SUMMARY OF THE INVENTION

A main object of the present invention is to provide a monocomponent developing device capable of producing superior images.

A further object of the present invention is to provide a monocomponent developing device capable of reliably supplying toner to an electrostatic latent image formed on the surface of a photoconductive member without damaging the surface of said photoconductive member.

A still further object of the present invention is to provide a monocomponent developing device having a thin film member that supplies toner to a surface and wherein said thin film member is disposed around the exterior circumference of a drive roller confronting a photoconductive member and has a circumferential length greater than the circumferential length of the drive roller, said monocomponent developing device forming uniform slack in the thin film member along the axial direction of the roller in the region wherein the roller confronts the photoconductive member and accomplishing developing by making the aforesaid slack come into contact with the surface of the photoconductive member.

These and other objects of the invention are accomplished by a developing device having the following elements:

a rotatable drive roller arranged so as to be rotatable;

a toner transporting means including a thin film member disposed around the exterior circumference of a drive roller and having a circumferential length greater than the circumferential length of said drive roller for transporting toner supplied onto the thin film member to the region wherein the drive roller confronts the photoconductive member;

a pressing means to press a thin film member toward the drive roller on the side opposed to the side confronting the photoconductive member of the drive roller so as to have the part of the thin film member confronting the photoconductive member protrude toward said photoconductive member and make contact with the surface of said photoconductive member; and adjusting means provided at both ends of the thin film member in the axial direction for adjusting the pressure applied by the pressing means to maintain constant, uniform pressure.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

A first embodiment of the present invention is described in detail hereinafter with reference to FIGS. 3 and 4.

Figure 1:
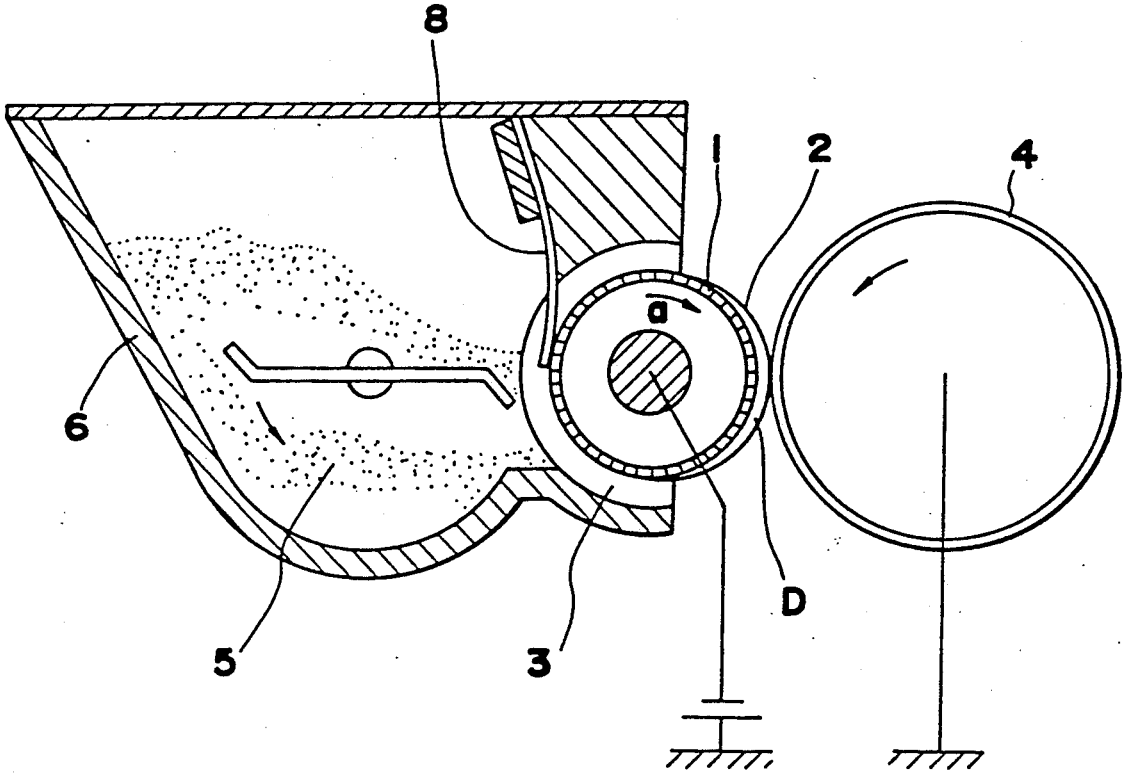
FIG. 1 PRIOR ART
FIG. 1 shows a brief section view of a conventional developing device.
Figure 2:
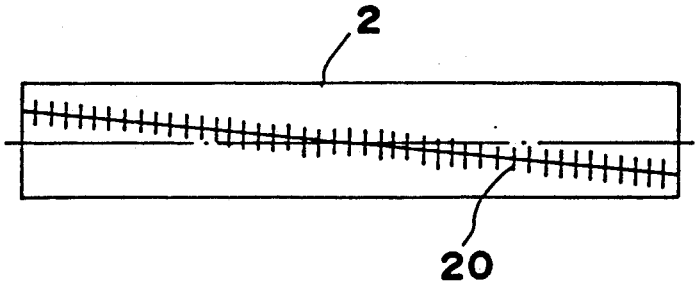
FIG. 2 PRIOR ART
FIG. 2 is an illustrative drawing showing the distribution of the slack portion of the thin film member in a conventional developing device.
Figure 3:
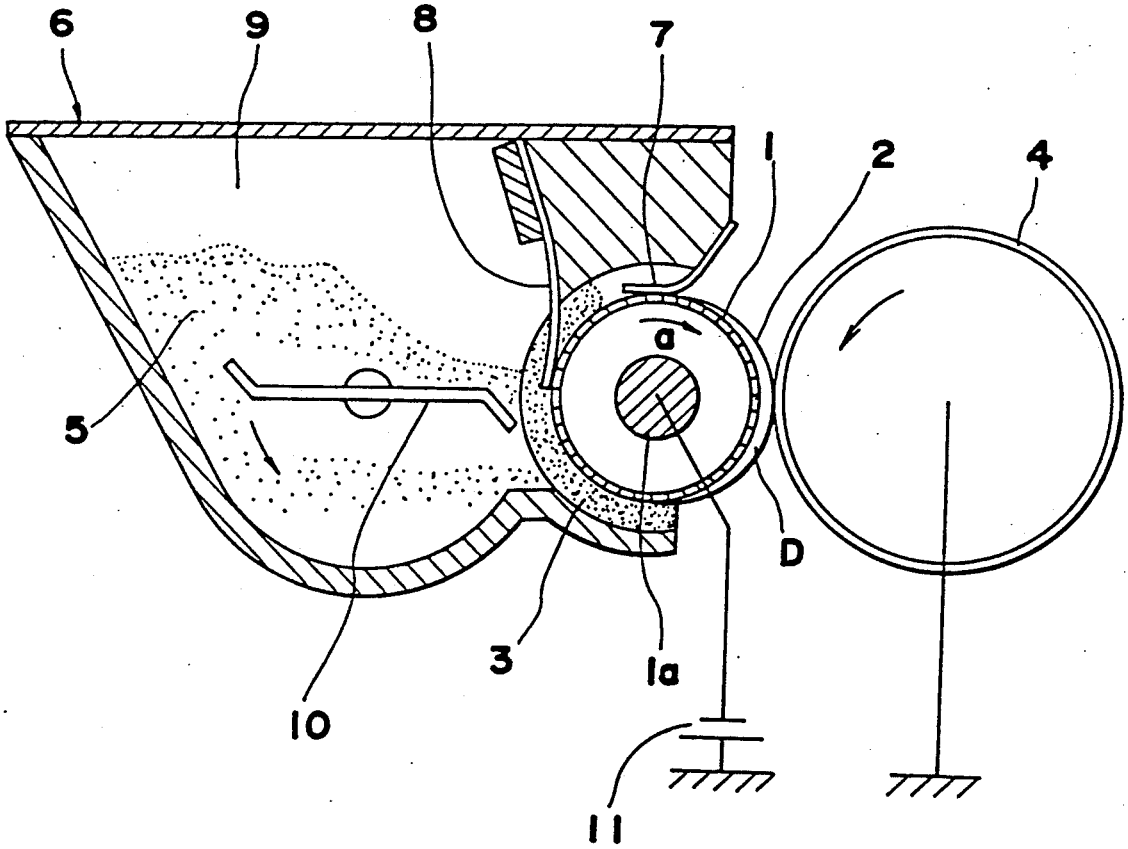
FIG. 3 is a brief section view of a first embodiment of the developing device of the present invention.
Figure 4:
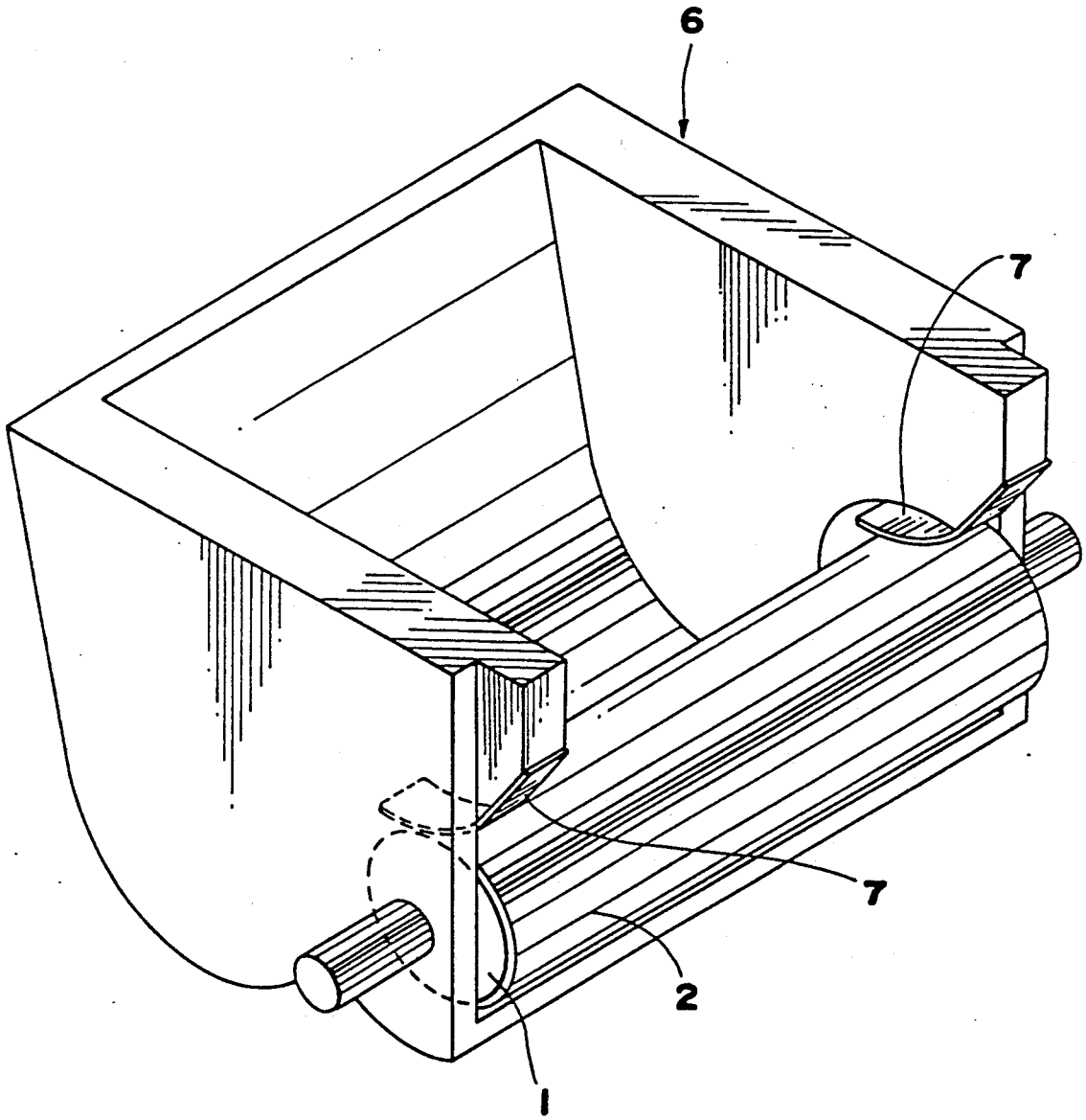
FIG. 4 is a brief perspective view showing the state of an elastic plate disposed at both ends of the toner transporting member in the axial direction in the developing device of the first embodiment.

In the embodiment of the developing device shown in FIGS. 3 and 4, casing 6 is open at the developing region wherein casing 6 confronts the image bearing member comprising photoconductive drum 4. In proximity to the aforesaid opening is provided an electrically conductive drive roller 1 at a specific spacing opposite photoconductive drum 4 within main unit 6 of the device. A sleeve-like thin toner transporting member 2 is arranged around the exterior surface of drive roller 1 and has a peripheral length slightly longer than the peripheral length of the aforesaid drive roller.

A bias voltage is applied to the shaft of electrically conductive drive roller 1, and the bias voltage acts upon toner transporting member 2 which is constructed of an electrically conductive material.

Guide members 3 constructed of an expanded material or the like are provided in the axial direction at both ends of toner transporting member 2 so as to be disposed medially between said transporting member 2 and casing 6. Toner transporting member 2 presses against the exterior surface of drive roller 1 inside casing 6 by means of the aforesaid guide members 3.

Also in the first embodiment, elastic plates 7 are arranged in the axial direction at both ends of toner transporting member 2 so as to face inwardly toward the interior of main unit 6 of the device from the top opening in casing 6, as shown in FIG. 3. In this way, toner transporting member 2 is pressed against the exterior surface of drive roller 1 in the axial direction at both ends thereof by means of each of the aforesaid elastic plates 7 at the opening in proximity to the developing region. Although elastic plates 7 are constructed of an electrically conductive material such as, for example, ribbon steel, SUS301, phosphor bronze, and the like, they may be constructed of an insulative material such as resin and the like.

When toner transporting member 2 is pressed against the exterior surface of drive roller 1 by guide members 3 and elastic plates 7 as previously described, said toner transporting member 2 is caused to begin protruding toward the photoconductive drum 4 side from the locations whereat constant uniform pressure is applied by elastic members 7 to press said toner transporting member 2 against the exterior surface of drive roller 1 because toner transporting member 2 has a peripheral length that is longer than the peripheral length of drive roller 1, such that toner transporting member 2 is guided through the opening of main unit 6 to the photoconductive drum 4 side and a slack portion "D" is formed. Slack portion "D" is normally maintained in a constant state in the developing region to make light contact with the surface of photoconductive drum 4.

When toner transporting member 2 is in the state of being pressed against the exterior surface of drive roller 1 by guide members 3 and elastic plates 7 and drive roller 1 is rotated by a driving device such as a motor or the like (not shown in the drawing), toner transporting member 2 is driven in a constant state in conjunction with the rotation of said drive roller 1 by means of a frictional force produced between transporting member 2 and drive roller 1 through the operation of guide members 3 and elastic members 7.

Also in the developing device of the present embodiment, toner 5 is accommodated within a toner hopper 9 behind toner transporting member 2, which is arranged around the exterior surface of drive roller 1, to wit, said hopper 9 is positioned on the side of toner transporting member 2 that is opposite the side that confronts photoconductive drum 4. An agitator 10 is provided within the aforesaid toner hopper 9, and regulating blade 8 presses against toner transporting member 2 in the location whereat toner transporting member 2 presses against drive roller 1.

In the developing device described above, the drive roller 1 is rotated in the opposite direction to the rotation of photoconductive drum 4 by a driving device such as a motor or the like (not shown in the drawing), toner transporting member 2 is driven in conjunction with the aforesaid rotation of drive roller 1, and agitator 10 disposed within toner hopper 9 is rotated so as to mix the toner 5 accommodated in toner hopper 9, and said toner 5 is supplied onto toner transporting member 2 which is driven in the manner previously mentioned.

The quantity of toner 5 supplied onto toner transporting member 2 in the manner described above regulated by regulating blade 8 before said toner 5 is transported by toner transporting member 2 to the photoconductive drum 4 side, and said toner 5 is triboelectrically charged between toner transporting member 2 and regulating blade 8.

Toner 5, the quantity of which has been regulated by regulating blade 8 and which has been triboelectrically charged and resides on toner transporting member 2, is transported from the opening of casing 6 to the developing region opposite photoconductive drum 4. In the developing region, toner transporting member 2 makes light contact with the surface of photoconductive drum 4, and the toner 5 on toner transporting member 2 is supplied to the location of the electrostatic latent image formed on the surface of photoconductive drum 4 by means of the action of a bias voltage acting on said toner transporting member 2, said bias voltage being supplied from a bias power source 11 connected to the shaft la of drive roller 1.

Although in the present embodiment drive roller 1 is constructed of an electrically conductive material, said drive roller 1 may be constructed of an insulative material, in which case bias power source 11 is connected to elastic plate 7 which is constructed of an electrically conductive material so as to allow the action of the bias voltage to be applied through said elastic plate 7.

Figure 5:
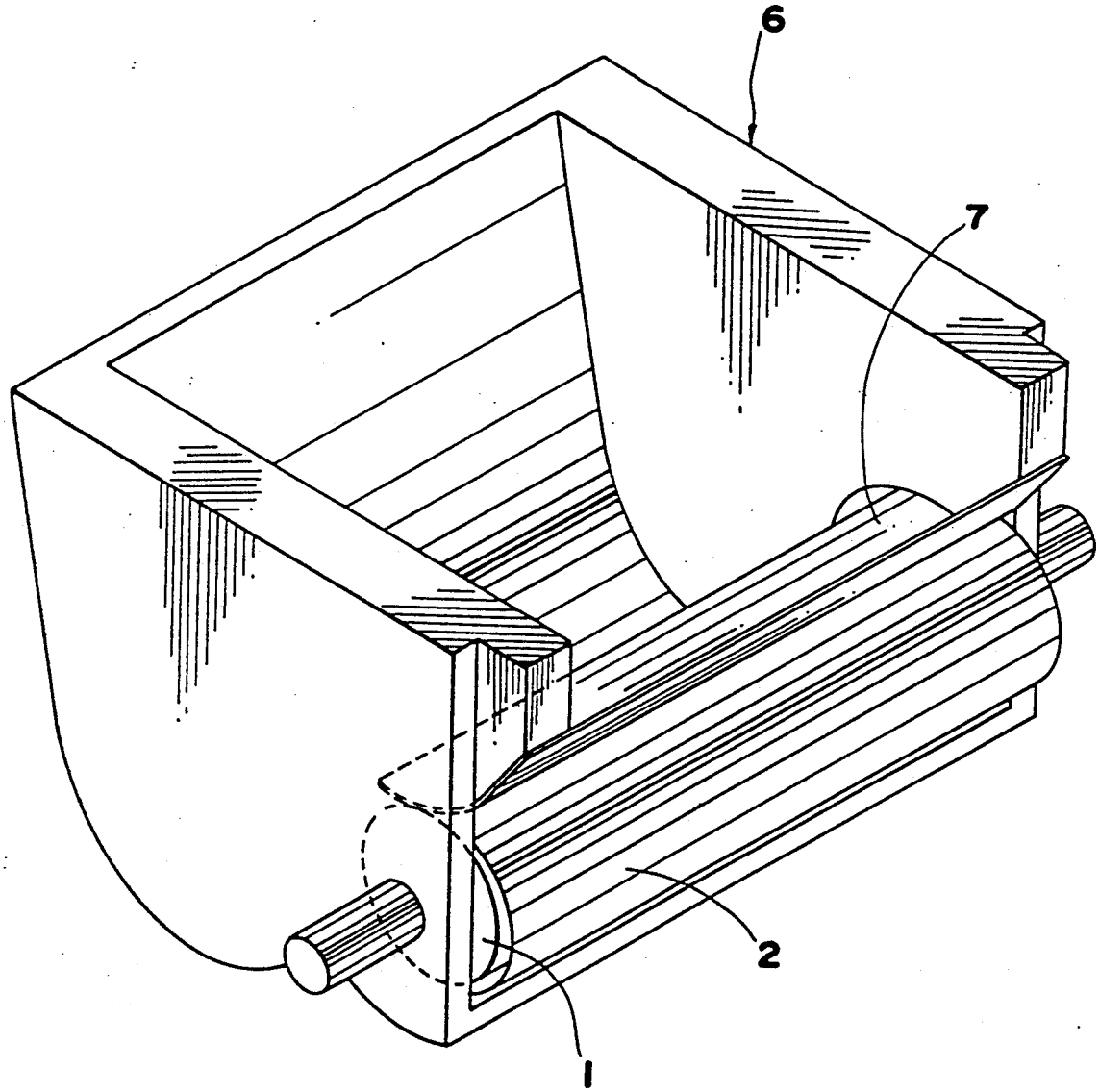
FIG. 5 is a brief perspective view of a modified elastic plate of the first embodiment.

Although, in the first embodiment, elastic plates 7 are arranged at both sides of toner transporting member 2 in the axial direction so as to face inward toward the inside of main unit 6 from the top opening of casing 6 in proximity to the developing region and both sides of toner transporting member 2 in the axial direction are pressed against the exterior surface of drive roller 1, as shown in FIG. 4, an elastic plate 7 may be arranged across the entire length of toner transporting member 2 in the axial direction so that toner transporting member 2 presses against the exterior surface of drive roller 1 along the entire length of said toner transporting member 2 in the axial direction at the opening in proximity to the developing region, as shown in FIG. 5.

When toner transporting member 2 is pressed against the exterior surface of drive roller 1 by means of an elastic member 7 arranged along the entire length of said toner transporting member 2 in the axial direction, effects other than those identical to effects produced by the first embodiment are obtained, and described hereinafter. That is, the protrusion of toner transporting member 2 toward the photoconductive drum 4 side is stabilized along the entire length of said toner transporting member 2 in the axial direction, so that the contact between the slack portion "D" of toner transporting member 2 and photoconductive drum 4 is uniform along the entire length of said member 2 in the axial direction. Accordingly, the contact between toner transporting member 2 and exterior surface of drive roller 1 on the side opposite to photoconductive drum 4 is stabilized by the provision of elastic plate 7 along the entire length of toner transporting member 2 in the axial direction, to wit, said contact is not only uniform along the entire length of said toner transporting member 2 but the nip width between slack portion "D" of toner transporting member 2 and photoconductive drum 4 is also uniform along the entire length of said toner transporting member 2 in the axial direction. Further, the quantity and triboelectric charging of toner 5 supplied on toner transporting member 2 is reliable even when regulation of said toner 5 is accomplished not by the previously mentioned regulating blade 8 but by elastic plate 7.

Figure 6:
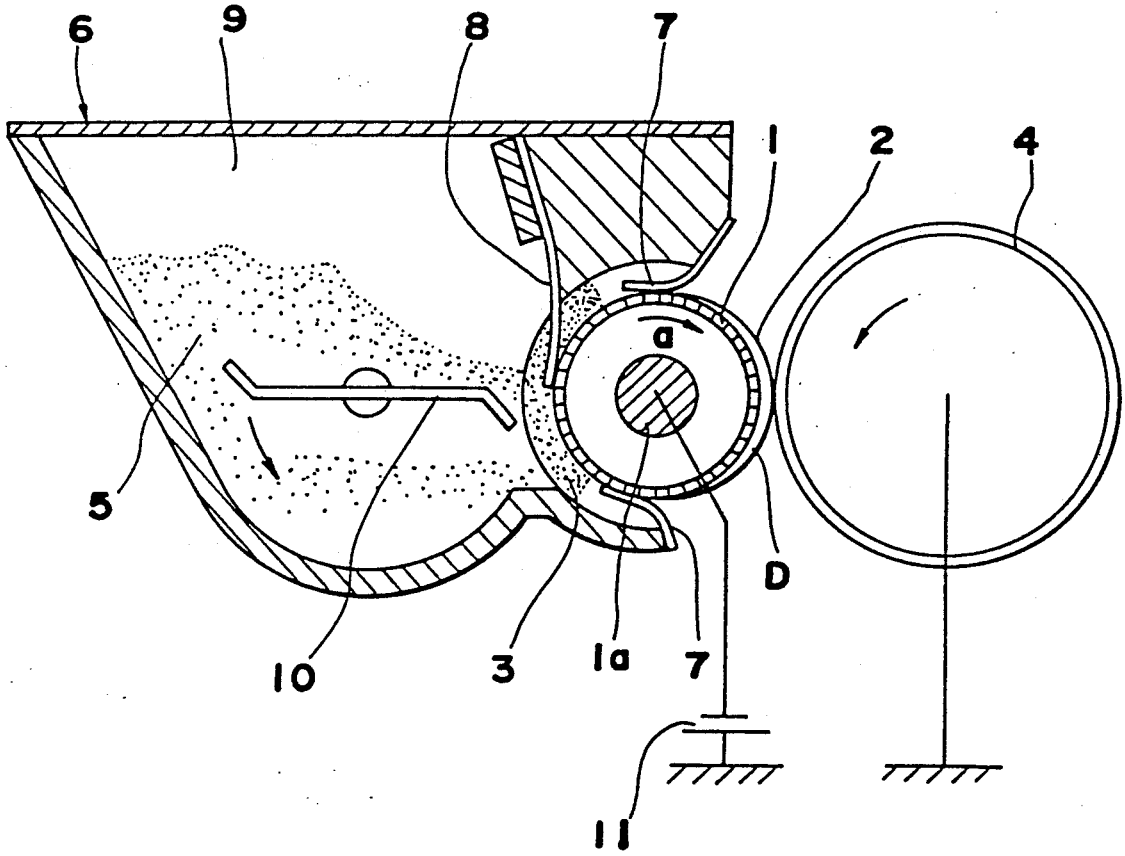
FIG. 6 is a brief section view of the developing device provided elastic plates at the top and bottom openings of the developing device.

Although in the present embodiment toner transporting member 2 is pressed against the exterior surface of drive roller 1 by means of elastic plate 7 arranged at the top opening of casing 6, said toner transporting member 2 may also be pressed against the exterior surface of drive roller 1 by means of elastic plates 7 arranged at the top and the bottom opening of casing 6, as shown in FIG. 6.

In addition, when an elastic plate is provided across the entire length of the toner transporting member in the axial direction, the regulation of the quantity of toner, triboelectric charging of toner and the pressing of the toner transporting member against the exterior surface of the drive roller may be accomplished by the elastic plate along without the aforesaid blade 8.

Figure 7:
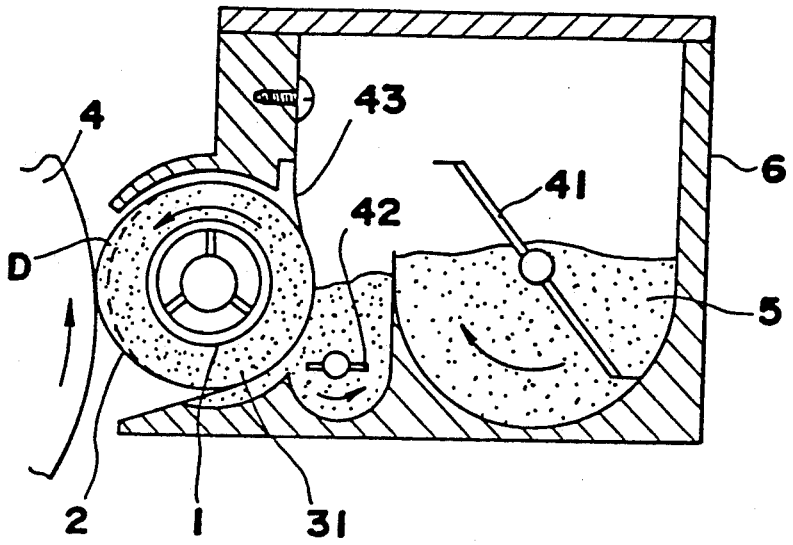
FIG. 7 is a brief section view of a second embodiment of the developing device of the present invention.

A second embodiment of the invention is described hereinafter with reference to FIGS. 7 through 12. FIG. 7 is an illustration briefly showing the essential construction of a second embodiment of the developing device. The developing device shown in FIG. 7 is provided a drive roller 1 that is rotated by a driving means not shown in the drawing and mounted on casing 6 which accommodates a monocomponent developing material 5 comprising a developing toner, and is provided a toner transporting member 2 around the exterior circumference of drive roller 1. Ring members 31 made of a soft elastic material such as expanded polyurethane (for example, molto pren (Trademark)) are arranged medially between both ends of drive roller 1 and both ends of toner transporting member 2.

Figure 8:
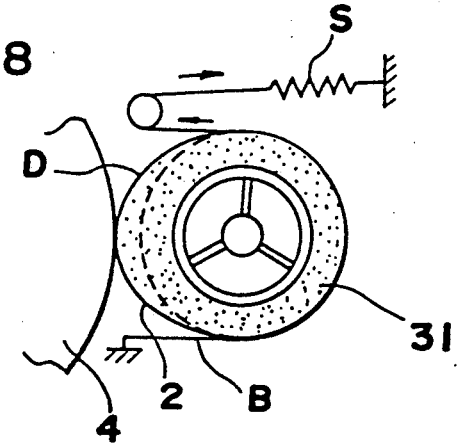
FIG. 8 is an illustrative drawing showing the construction of the toner transporting member pressing mechanism in the device of FIG. 7.

Details of drive roller 1 are shown in FIG. 8 which shows said drive roller 1 is provided an expanded silicone layer 11 superimposed on the exterior surface of a metallic shaft 12. Toner transporting member 2, which is provided around the exterior surface of the silicone layer 11, presses against drive roller 1 from inside casing 6 by having a pressure belt "B" stretched by a spring "S" so as to make semicircular-like contact with the exterior surface of both ends of said roller, thereby forming a slack portion "D" which protrudes outside casing 6, such that said slack portion "D" makes contact with photoconductive drum 4 which is the electrostatic latent image bearing member.

Stable and uniform pressure contact can be accomplished between the exterior surface of ring members 31 and toner transporting member 2 on the side opposite to the side confronting photoconductive drum 4 of the drive roller 1 even when the previously described pressure belt "B" is used in place of the aforesaid guide member 3 and elastic plate 7 of the First Embodiment.

Developing material 5 inside casing 6 is mixed by agitator 41 and transported toward rotatable transporting member 42, and is thereafter supplied to toner transporting member 2 by said rotatable transporting member 42. Inside casing 6, a regulating member blade 43 makes contact with the surface of toner transporting member, so as to regulate the quantity of toner adhering to the surface of said toner transporting member 2 while simultaneously triboelectrically charging said toner by means of the pressure applied by said regulating member on toner transporting member 2. When drive roller 1 is rotated in the arrow "b" direction by a driving means not shown in the drawing, as shown in FIG. 7, toner transporting member 2 is also caused to rotate in the same direction due to the frictional force produced between the surface of drive roller 1 and the interior surface of toner transporting member 2.

Figure 10:
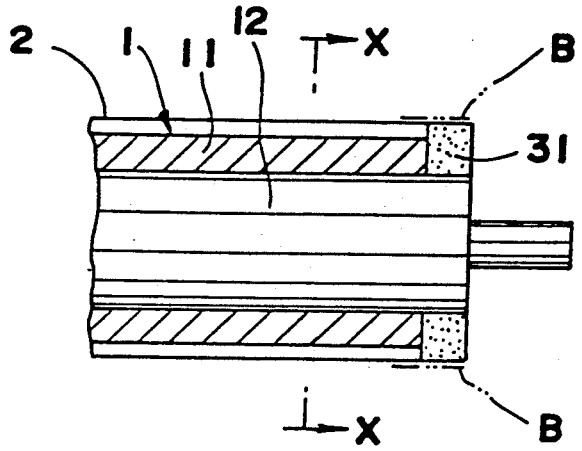
FIG. 10 is a section view showing the toner transporting member arranged around the exterior circumference of the drive roller shown in FIG. 9.
Figure 11:
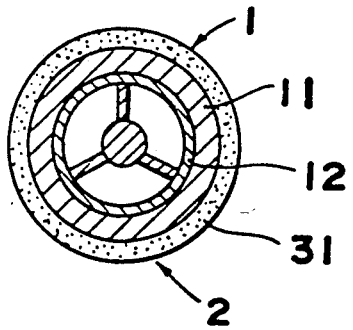
FIG. 11 is a section view of FIG. 10 along the X—X line.

The electrostatic latent image formed on the surface of photoconductive drum 4 is subsequently developed. A description of ring-like member 31 follows hereinafter. The exterior diameter of ring members 31 is somewhat larger than the interior diameter of toner transporting member 2. Before drive roller 1 and toner transporting member 2 are assembled in casing 6 of the developing device, toner transporting member 2 is disposed around the exterior surface of drive roller 1 with the ring members 31 in a compressed state, as shown in FIGS. 10 and 11. At this time, the center axial line of toner transporting member 2 is readily unified with the rotational shaft line of drive roller 1 by means of the action of ring members 31.

Drive roller 1 and toner transporting member 2 are installed in casing 6 of the developing device in the previously described state, and thereafter both ends of toner transporting member 2 are pressed toward the exterior surface of ring members 31 by pressure belt "B," as shown in FIG. 8. FIG. 10 indicates the contact positions of pressure belt "B" with two dotted lines.

Figure 9:
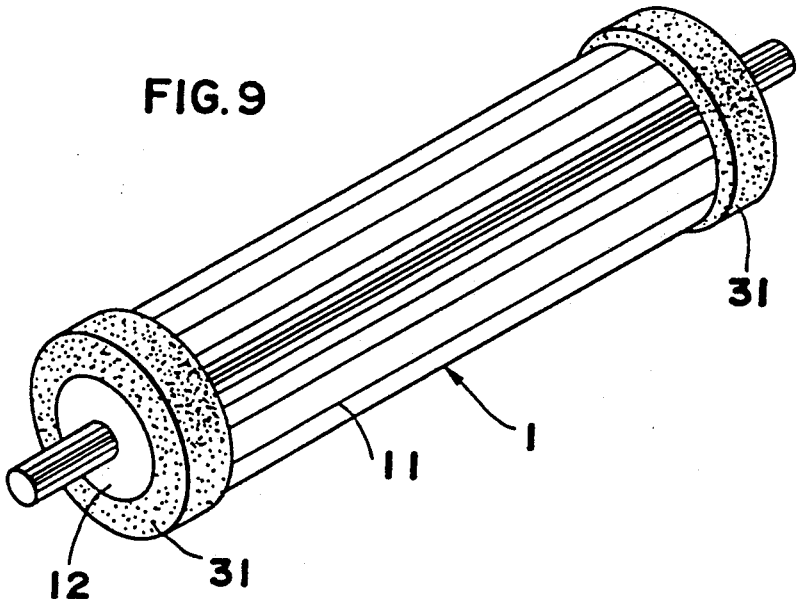
FIG. 9 is a perspective view of the drive roller of the second embodiment.

Pressure belt "B" compresses ring members 31 and presses toner transporting member 2 until said toner transporting member 2 reaches the surface of expanded silicone layer 11 of drive roller 1. The result is that toner transporting member 2 forms a slack portion "D" at the opening of casing 6, and the inside of said slack portion "D" at both ends of member 2 are filled by elastic ring members 31 which have an elastic return to compensate for the space produced on the inside of said slack portion "D," such that said slack portion "D" is maintained from the inside. The restoring force at both ends of toner transporting member 2 in the axial direction is quite strong due to the maintenance from the inside by elastic ring members 31. FIG. 9 shows a perspective view of the previously described state.

The nip width of the toner transporting member 2 and the photoconductive member 4 can not be uniformly maintained because both ends of the toner transporting member 2 is deformable due to the weak restoring force thereof. However, since the maintenance of the slack portion of toner transporting member 2 from the inside by both elastic ring members 31 is continuously maintained even during the movements of the developing operation, the nip width of the toner transporting member 2 and the photoconductive member 4 is uniformly maintained across the axial direction of toner transporting member 4. density can be prevented by a difference in the nip width.

Further, wave-like deformation of the slack portion at both ends of toner transporting member 2 in the rotational direction of drive roller 1 are prevented by maintaining both ends of said toner transporting member 2, which has a weak restoring force, from the inside of said member 2. Accordingly, image defects arising from deformations in the slack portion are also prevented.

Before setting drive roller 1 and toner transporting member 2 to developing device casing 6, the center axial line of toner transporting member 2 is unified with the rotational shaft line of drive roller 1. Accordingly, slack portion "D" can be set parallel to the rotational axis direction of drive roller 1 without inclining said slack portion "D" relative to the rotational axis direction of drive roller 1 when the slack portion "D" of toner transporting member 2 is formed by setting the drive roller 1 and toner transporting member 2 to the developing device casing 6, as shown FIGS. 10 and 11. Poor image quality and damage to the toner transporting member 2 resulting from inclination of said toner transporting member 2 are thus prevented.

Further, the sealing of the developing material at both ends of the toner transporting member 2 and the pressure applied by the pressure belt "B" to both ends of toner transporting member 2 are readily stabilized.

A third embodiment of the invention is hereinafter described.

Figure 13:
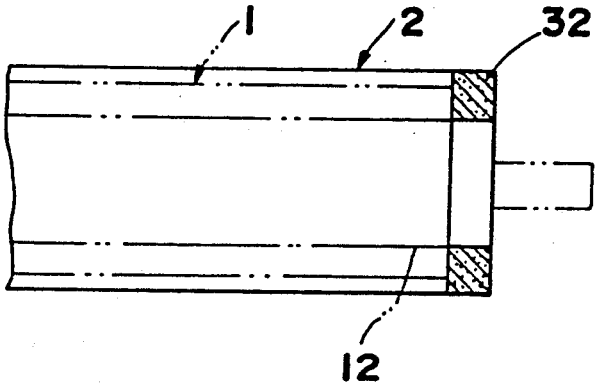
FIG. 13 is a section view showing a third embodiment of the toner transporting member and drive roller.

The third embodiment, as shown in FIG. 13, provides soft elastic ring members 32 at both ends of the interior surface of toner transporting member 2 which are equivalent to the soft elastic ring members 31 provided to both ends of drive roller 1 in the previous embodiment.

Figure 14:
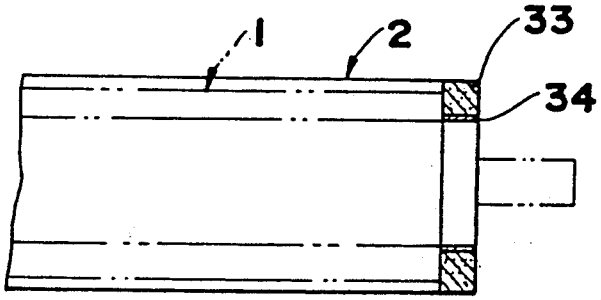
FIG. 14 is a section view showing a fourth embodiment of the toner transporting member and drive roller.

A fourth embodiment of the invention, as shown in FIG. 14, provides, in addition to the soft ring members 33 disposed at the inside of both ends of toner transporting member 2, pliable elastic supplemental ring members 34 which are slightly harder than ring members 33 on the inside surface of said ring members 33.

Figure 15:
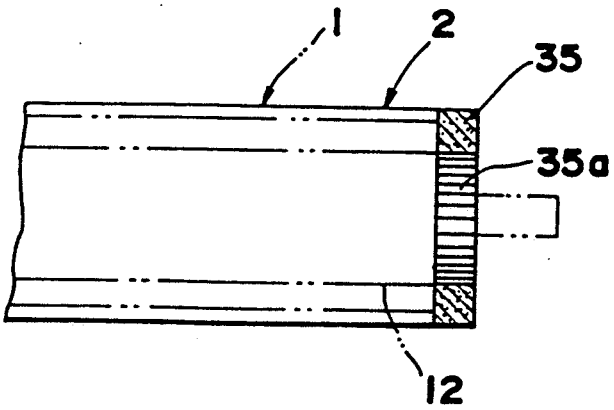
FIG. 15 is a section view showing a fifth embodiment of the toner transporting member and drive roller.

A fifth embodiment of the invention, as shown in FIG. 15, provides soft elastic ring members 35 at each inside end of toner transporting member 2, said ring members 35 being formed so as to have a toothed portion 35*a* on the inner side thereof.

Figure 16:
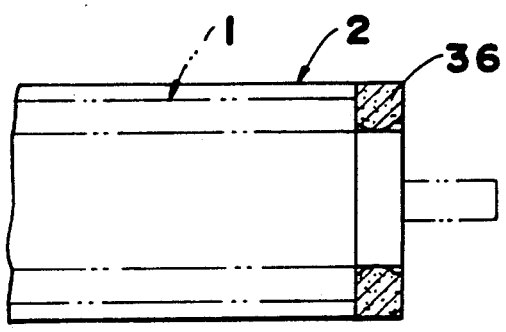
FIG. 16 is a section view showing a sixth embodiment of the toner transporting member and drive roller.

A sixth embodiment of the invention, as shown in FIG. 16, provides a silicone rubber coating 36 on the inner surface at both ends of toner transporting member 2, said silicone rubber coating 36 forming pliable elastic rings.

Each of the toner transporting members 2 shown in FIGS. 13 through 16 are disposed on the exterior surface of drive roller 1, and soft elastic ring members 32, (33 and 34), 35 and 36 are provided in a state wherein they are compressed by toner transporting member 2 on the exterior surface at both ends of center shaft 12 of drive roller 1. The fifth embodiment shown in FIG. 15 has a toothed portion 35*a* provided on the interior surface of ring member 35, said toothed portion 35*a* engaging and meshing with a tooth portion (not shown in the drawing) formed on the exterior surface at both ends of center shaft 12 of drive roller 1.

The drive rollers 1 and toner transporting rollers 2 shown in FIGS. 13 through 16 are mounted to casing 6 of the developing device, and toner transporting member 2 is pressed toward drive roller 1 in the same manner as described in the second embodiment show in FIG. 7. Both ends of the slack portion "D" of toner transporting member 2 formed in the aforesaid manner are elastically maintained from the inside of toner transporting member 2 by means of the elastic restoring force of the pliable elastic ring members causing expansion at both ends of toner transporting member 2 in the same manner as described for the second embodiment shown in FIG. 8.

Figure 12:
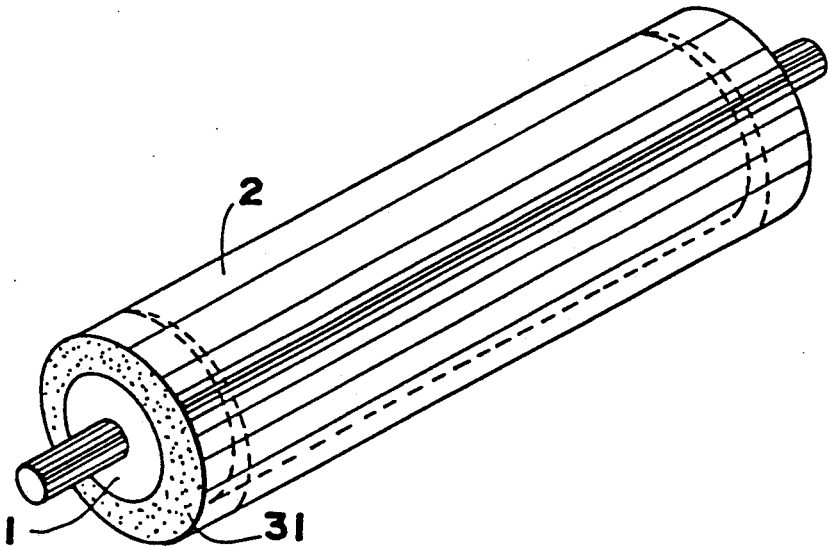
FIG. 12 is a perspective view of the drive roller and toner transporting member of FIG. 8.
Figure 17:
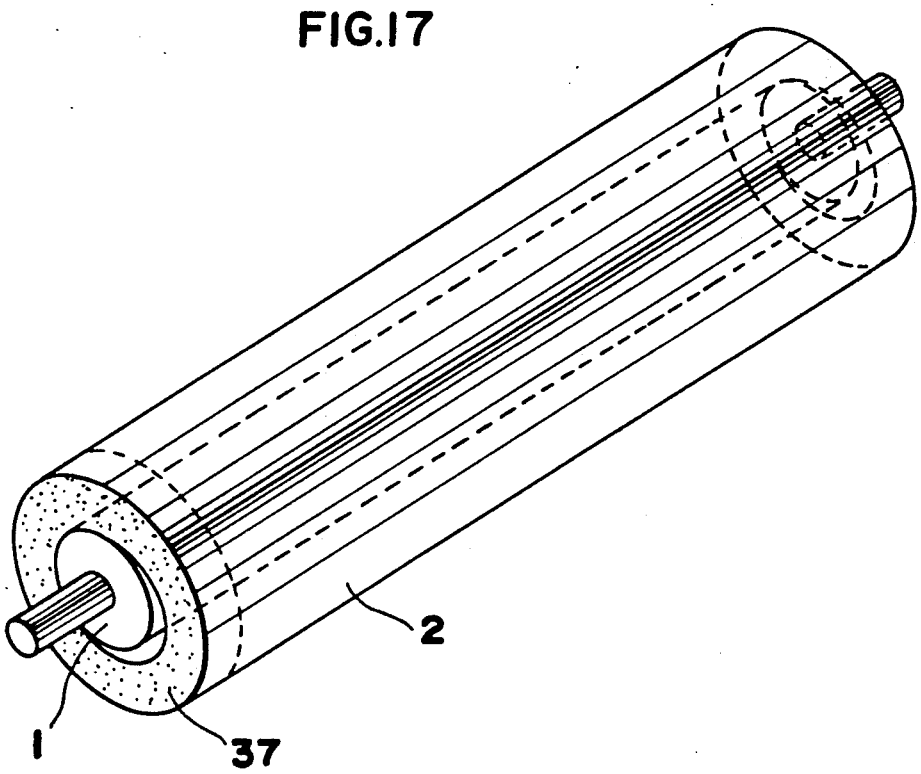
FIG. 17 is a perspective view showing a modification of the third through sixth embodiments of the toner transporting member and drive roller.

Although in the previously described second through sixth embodiment of the invention the inner side of the slack portion at both ends of toner transporting member 2 between the drive roller 1 and toner transporting member 2 is completely filled by the pliable elastic rings, as shown in FIG. 12, when a pliable elastic ring 37 is provided at the inside of toner transporting member 2, as shown in FIG. 17, said pliable elastic ring 37 may have some slight gap relative to drive roller 1 in the slack portion of toner transporting member 2.

In the previously described second through sixth embodiments of the invention, the hardness $K_1$ of expanded silicone layer 11 on drive roller 1 and the hardness $K_2$ of the pliable ring members backing up both ends of toner transporting member 2 have a relationship expressed by the expression: $K_1 > K_2$. Accordingly, pressure belt "B" compresses said pliable elastic ring members, and toner transporting member 2 presses against regulating member 43 (refer to FIG. 7) and drive roller 1 with suitable pressure.

Although in the previously described embodiments elastic ring members have been described as being provided on the interior side of toner transporting member 2, the toner transporting member may be provided an additional thickness on the interior side at both ends thereof so as to increase the restoring force thereof without using the aforesaid pliable elastic ring members.

Although the present invention has been fully described by way of examples with reference to the accompanying drawings, it is to be noted that various changes and modifications will be apparent to those skilled in the art. Therefore, unless otherwise such changes and modifications depart from the scope of the invention, they should be construed as being included therein.

What is claimed is:

1. A developing device comprising:

a rotatable drive roller confronting a rotatable photoreceptor;

toner transporting means including a flexible member disposed around the exterior surface of said drive roller and having a peripheral length greater than the peripheral length of the drive roller for transporting toner supplied onto the flexible member to a confronting region wherein the drive roller confronts the photoreceptor;

pressing means for pressing the flexible member to the drive roller on the side opposed to the side confronting the photoreceptor of the drive roller, thereby the flexible member protrudes toward the photoreceptor in order to contact with the surface of the photoreceptor at said confronting region; and adjusting means provided separately from the pressing means at both ends of the flexible member in an axial direction thereof for adjusting the pressure applied by the pressing means so as to be uniform and constant.

2. A developing device as claimed in claim 1 wherein said pressing means has an elastic pad arranged on the side opposed to the side confronting the photoreceptor of the drive roller, and said adjusting means has an elastic plate for pressing the flexible member to the exterior surface of the drive roller at least on both ends of the flexible member in the axial direction thereof.

3. A developing device as claimed in claim 1 wherein said adjusting means usable as pressing means has a belt member in contact with the exterior surface of the flexible member on the side opposed to the side confronting the photoreceptor of the drive roller and urging means for urging said belt member toward the photoreceptor

4. A developing device comprising:

a drive roller rotatable in a predetermined direction and confronting a rotatable photoreceptor on the surface of which an electrostatic latent image is formed;

a flexible member disposed around the exterior surface of said drive roller and having a peripheral length greater than the peripheral length of the drive roller, said flexible member rotating in the predetermined direction with the rotation of the drive roller;

supplying means for supplying a toner onto the exterior surface of the drive roller; and pressing means provided at both ends of the flexible member in an axial direction thereof for making the flexible member protrude toward the photoreceptor and contacting with the surface of the photoreceptor, said pressing means having an elastic pad arranged on the side opposed to the side confronting the photoreceptor of the drive roller and an elastic plate disposed at least on each of the upper side or the lower side of the exterior surface of the flexible member.

5. A developing device as claimed in claim 4 wherein said elastic pad presses the flexible member toward the photoreceptor and said elastic plate presses the flexible member in a direction crossing the direction in which the elastic pad presses the flexible member.

6. A developing device as claimed in claim 4 wherein said drive roller is insulative and said elastic plate is conductive, said elastic plate being applied with a bias voltage.

7. A developing device comprising:

a drive roller rotatable in a predetermined direction and confronting a rotatable photoreceptor on the surface of which an electrostatic latent image is formed;

a flexible member disposed around the exterior surface of said drive roller and having a peripheral length greater than the peripheral length of the drive roller, said flexible member rotating in a predetermined direction with the rotation of the drive roller for transporting toner supplied onto the flexible member to a confronting region wherein the drive roller confronts the photoreceptor;

first pressing means provided at both ends of the flexible member in an axial direction thereof for pressing the flexible member toward the photoreceptor to contact with the surface of the photoreceptor, thereby the toner is supplied to the electrostatic latent image formed on the surface of the photoreceptor; and second pressing means arranged along the entire length of the flexible member for pressing the flexible member in a direction crossing the direction in which said first pressing means presses the flexible member.

8. A developing device as claimed in claim 7 wherein said first pressing means has an elastic pad arranged on the side opposed to the side confronting the photoreceptor of the drive roller and said second pressing means has an elastic plate arranged along the entire length of the flexible member.

9. A developing device as claimed in claim 8 wherein said elastic plate is usable as regulating means for charging the toner on the exterior surface of the flexible member and regulating the quantity of the toner on the exterior surface of the flexible member.

10. A developing device comprising:

toner transporting means confronting a rotatable photoreceptor on the surface of which an electrostatic latent image is formed and having a cylindrical flexible member disposed so a to rotate;

supplying means for supplying a toner onto the exterior surface of said flexible member;

a rotatable drive roller provided inside of the flexible member and having a peripheral length smaller than the peripheral length of the flexible member, the flexible member rotating with the rotation of the drive roller for transporting toner supplied onto the flexible member to a confronting region wherein the drive roller confronts the photoreceptor; and pressing means provided at both ends of the flexible member in an axial direction thereof and having a belt member disposed on the exterior surface of the flexible member on the side opposed to the side confronting the photoreceptor of the drive roller and urging means for urging said belt member toward the photoreceptor, thereby flexible member protrudes toward the photoreceptor to contact with the surface of the photoreceptor.

11. A developing device as claimed in claim 10 further comprising:

an elastic member including an elastic ring member which is arranged between the drive roller and the flexible member at both ends of the flexible member in the axial direction thereof, said elastic ring member pressing in contact with the inner surface of the flexible member for supporting the flexible member from the inside thereof.

12. A developing device comprising:

a drive roller rotatable in a predetermined direction and confronting a rotatable photoreceptor on the surface of which an electrostatic latent image is formed;

toner transporting means including a flexible member disposed around the exterior surface of said drive roller and having a peripheral length greater than the peripheral length of the drive roller, said flexible member rotating in a predetermined direction with the rotation of the drive roller for transporting toner supplied onto the flexible member to a confronting region wherein the drive roller confronts the photoreceptor;

pressing means provided at both ends of the flexible member in an axial direction thereof for pressing the flexible member toward the photoreceptor to contact with the surface of the photoreceptor, thereby the toner is supplied to the electrostatic latent image formed on the surface of the photoreceptor; and an elastic member arranged between the drive roller and the flexible member at both ends of the flexible member in the axial direction thereof and pressing in contact with the inner surface of the flexible member for supporting the flexible member from the inside thereof.

13. A developing device as claimed in claim 12 wherein said elastic member includes an elastic ring member arranged on the exterior surface of the drive roller at both ends of the drive roller in the axial direction thereof.

14. A developing device as claimed in claim 12 wherein said elastic member has an elastic ring arranged on the inner surface of the flexible member at both ends of the flexible member in an axial direction thereof.

15. A developing device as claimed in claim 13 wherein said drive roller is composed of a metallic roller and an expanded silicone layer provided on the exterior surface of said metallic roller, the hardness of the expanded silicone layer being greater than that of the elastic ring member.

16. In a developing device comprising a drive roller rotatable in a predetermined direction and confronting a rotatable photoreceptor on the surface of which an electrostatic latent image is formed and toner transporting means including a flexible member which is disposed around the exterior surface of said drive roller and has a peripheral length greater than the peripheral length of the drive roller for transporting toner supplied onto the flexible member to a confronting region wherein the drive roller confronts the photoreceptor, a method comprising the steps of:

pressing the flexible member from the side opposed to the side confronting the photoreceptor of the drive roller toward the photoreceptor by means of first pressing means provided at the both ends of the flexible member in an axial direction thereof, so that the flexible member protrudes toward the photoreceptor; and pressing the flexible member by means of second pressing means provided at least on the center portion of the flexible member in the axial direction thereof in a direction crossing the direction in which the flexible member is pressed by said first pressing means.

* * * * *